US005493840A

United States Patent [19]

Cane

[11] Patent Number: 5,493,840

[45] Date of Patent: Feb. 27, 1996

[54] MEANS FOR PROVIDING FLOWABLE COLOURANT IN A COATING COMPOSITION

[75] Inventor: Michael R. Cane, Cambridge, United Kingdom

[73] Assignee: Imperial Chemical Industries PLC, London, United Kingdom

[21] Appl. No.: 194,501

[22] Filed: Feb. 9, 1994

[30] Foreign Application Priority Data

Feb. 10, 1993 [GB] United Kingdom ..... 9302611

[51] Int. Cl.[6] ..... B65B 3/36; B65B 37/16; B65B 59/00; B67B 7/00

[52] U.S. Cl. ..... 53/50; 53/168; 53/237; 53/258; 141/94; 141/104

[58] Field of Search ..... 53/468, 474, 50, 53/168, 237, 240, 258; 141/94, 104; 222/142.1, 168.5, 168; 366/605

[56] References Cited

U.S. PATENT DOCUMENTS

| | | | |
|---|---|---|---|
| 4,585,148 | 4/1986 | Ito | 141/104 X |
| 4,827,993 | 5/1989 | Ito et al. | 141/104 X |
| 4,967,938 | 11/1990 | Hellenberg | 141/104 X |
| 5,083,591 | 1/1992 | Edwards et al. | 141/94 X |
| 5,159,962 | 11/1992 | Dow | 141/94 X |
| 5,337,473 | 8/1994 | Weinstein | 53/168 X |

*Primary Examiner*—James F. Coan
*Attorney, Agent, or Firm*—Cushman Darby & Cushman

[57] ABSTRACT

A more easily useable means for providing dispersed flowable colorant in a coating composition contained in a liddable container which means may have none of several alternative heights. The means comprises dispenser 18 at which a dose of flowable colorant 1 can be introduced into a container 20 which contains a base paint 2. A shaker 24 is provided and is laterally spaced from the dispenser 18. A surface 14 extends from the dispenser 18 to the shaker 24 along which the container can be moved making transfer to the mixing station particularly easy. The means can also include labelling and lidding stations 22, 23 between the dispenser and shaker 18, 24. FIG. 1 .

18 Claims, 7 Drawing Sheets

MEANS FOR PROVIDING FLOWABLE COLOURANT IN A COATING COMPOSITION

Figure 1:
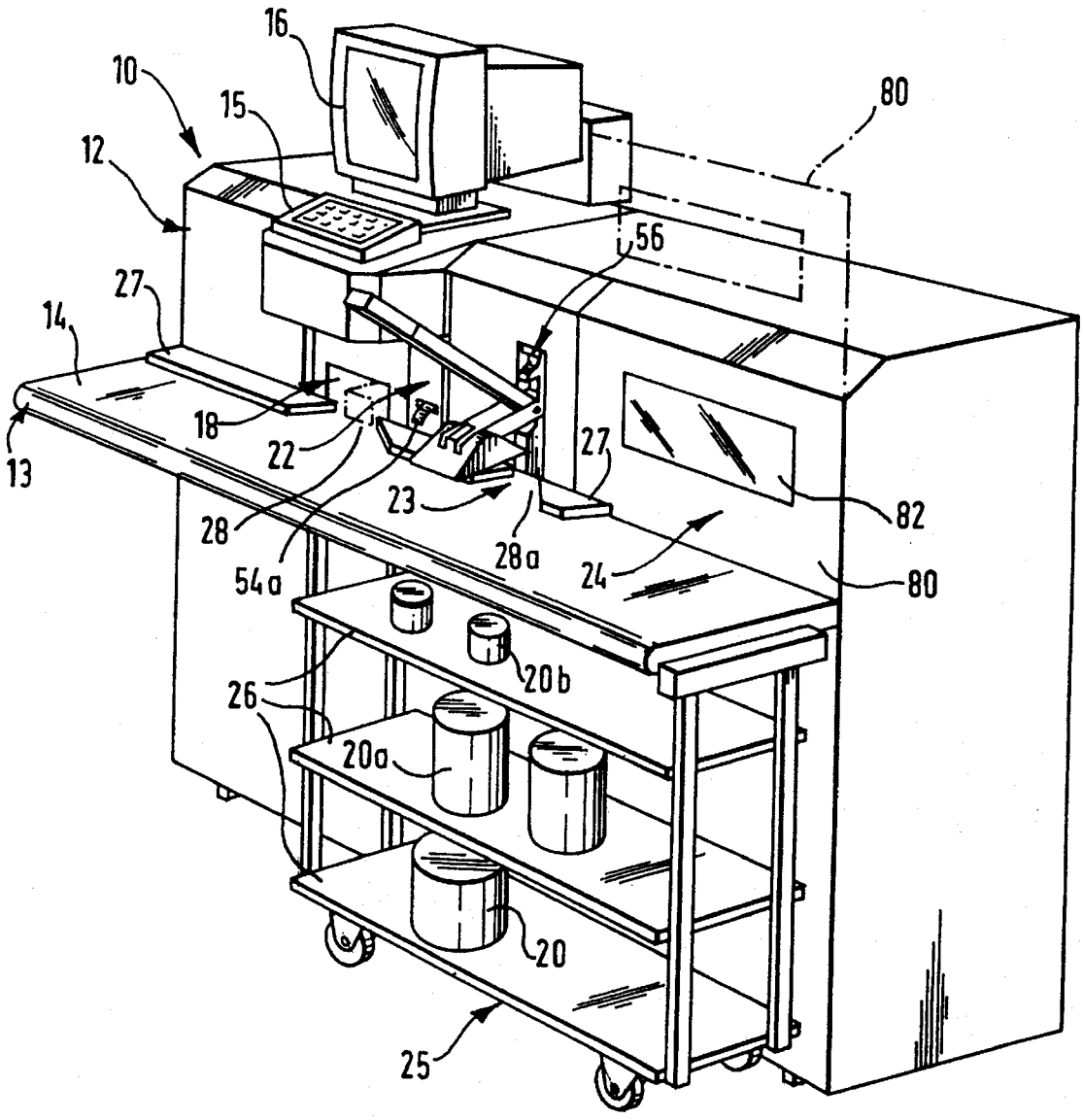

The invention relates to a means for providing dispersed flowable colourant in a coating composition such as a paint, varnish, woodstain or the like contained in a liddable container, which container may have one of several alternative capacities (for example 1 or 2.5 liters) and therefore one of several alternative heights. "Paint" includes traditional paints based on organic solvents and also paints based on aqueous solvents many of which are known as emulsion or latex paints. The flowable colourant (including white and black colourants) may be any material which can be caused to flow well enough to enable it to be pumped through a dispensing nozzle. Dispensing nozzles usually have a diameter of from 2 to 6 mm.

The invention especially relates to a means for introducing a dose of (usually liquid or semi-solid) colourant to a base paint contained in a liddable paint container and which is especially suitable for use in stores which supply tradesmen, that is to say professional painters. Such introduction of colourants into paint in stores is often known as "in-store tinting". In-store tinting allows a much wider range of colours to be offered than would be possible if containers of each individual coloured paint had to be stocked. That is because the space which would be needed to stock a large number of coloured paints is much greater than the space needed to stock containers of base paint and colourant.

For 30 years or more, typical in-store tinting systems have employed firstly a colourant-dispenser comprising a plurality of (usually 6 to 30) dispensing nozzles through each of which one of a variety of alternative colourants could be pumped into a liddable container filled with base paint or the like and secondly a shaker for dispersing the colourant in the base paint. The dispenser and shaker are separate machines. On receiving an order from a customer, an operator feeds into the colourant-dispenser the information relevant to the particular order and collects a lidded container of base paint or the like from a storage area usually located some distance from the dispenser. A lidded container of the correct capacity and base paint will be chosen from a stock of containers of alternative capacities and containing alternative base paints. The lid is removed and the container then placed in the dispenser (which usually involves the opening and closing of an access door), and then at least the smaller containers are raised towards the dispensing nozzles. This is necessary to bring the outlets of the nozzles close to the surface of the base paint in the container for otherwise if an outlet were to become slightly blocked, the stream of dispensed colourant could be deflected and the deflection could be sufficient to cause the deflected stream of colourant to miss the open mouth of the unlidded container. After dispensing, those containers which have been raised are lowered again. Each container is then removed from the dispenser and the operator applies a label before replacing the lid. To replace the lid, the container is transferred to the floor the lid is laid over the open mouth of the container and then (thus risking spillage) the operator uses his foot to apply pressure to the lid so that the lid press fits into the open mouth. Next, the re-lidded container is carried to the shaker. A door on the shaker is opened, the container is placed in a mixing compartment and door is closed before switching on the shaker. After the shaker has run for a pre-determined amount of time, the door is opened and the container removed and given to the customer. It is quite usual for the entire operation from the feeding of the information into the colourant-dispenser to the removing of the container from the shaker to take around two minutes. Whilst two minutes is not a serious delay at certain times of the day, it is known that trade stores tend to have peak and slack periods. For example, it is usual for a trade store to be particularly busy after first opening in the morning when tradesmen collect paint for use that day. At lunchtime, the store again tends to be rather busy as tradesmen collect further paint to top up their supply. The end of the working day can also be a peak time when tradesmen collect paint for use very early the next morning. At peak times, queues quickly build up as stores serve large numbers of tradesmen and the time taken for the in-store tinting then becomes critical.

An object of the present invention is to reduce the tendency for queues to form in paint stores when tradesmen are having base paint or the like coloured using an in-store tinting system.

According to one aspect of the invention there is provided means for providing dispersed flowable colourant in a coating composition contained in a liddable container which container may have one of several alternative heights, the means comprising a colourant-dispenser comprising a plurality of dispensing nozzles through which flowable colourant can be pumped into the container when unlidded and a shaker laterally spaced from the dispenser wherein a fixed shelf extends between the dispenser and the shaker along which shelf the container can be moved from the dispenser to the shaker and wherein the nozzles of the dispenser can be raised and lowered relative to the fixed shelf.

By providing raisable and lowerable dispensing nozzles it becomes possible to have a fixed horizontal shelf extending between the dispenser and the shaker and so the carrying of the container between the dispenser and the shaker can be eliminated as the operator can simply slide the container along the shelf from the colourant-dispenser to the shaker thereby saving time and effort. In addition there is no need to wait for a container to be lowered after dispensing has finished. All containers can be moved immediately after dispensing so saving precious seconds.

Preferably the selection and dispensing of the colourant is computer-controlled and input means such as a keyboard may be provided to enable an operator to feed information into the computer relevant to customer requirements. In addition the computer is preferably programmed to recognise the capacity and therefore the height of the appropriate container of base paint so that it can control the raising and lowering of the dispensing nozzles. In order to ensure that colourant will not be released before a container is in position to receive it, the colourant-dispenser may include a sensor-device for detecting the presence of the container.

The containers preferably carry a detectable code means such as a bar code which can be sensed at or near the colourant-dispenser. The code means may also be arranged to provide the computer with information which is relevant to the container itself, e.g., its height, and/or which is relevant to the base paint, or similar base composition in the container.

Information provided by sensing the code means may be compared in the computer to the information fed via the input means to provide a check that the container placed in a position to receive the colourant contains the correct amount of the correct base paint or the like. In that ways if the operator feeds correct information to the computer but, mistakenly chooses a container containing the wrong base paint or even the wrong volume of base paints the computer, on receiving the sensed code on the container, will provide a signal to the operator to indicate that a wrong container has been chosen.

In order to assist the operator in positioning the container to receive the colourant, positive location means may be provided, (for example on the shelf) which locates the container in a correct position. The location means may take the form of a V-shaped recess which can locate the base of the container somewhat after the manner of a V block. It has been found that a "V" having an angle of from 27° to 33° between its arms is especially universal in its ability to locate most conventional cylindrical containers having a capacity in the range 1 to 5 liters.

Because of the use of dispensing nozzles which are raisable and lowerable to accommodate containers of various heights, it is preferable for safety reasons to include a cut-off means which will cause lowering movement to cease if a hand or finger of an operator is encountered during such movement. Conveniently, the cut-off means may include a movable plate, bar or the like mechanically linked to a switch which it can actuate to switch off the drive for the lowering movement.

As mentioned above, existing in-store tinting involves the operator typically placing the unlidded container on the floor and re-applying the lid using his foot. Not only does that involve the operator in bending down to place the container on the floor and then lifting it again when carrying it to the shaker but also there is the risk that the operator can tip over the tin of paint which applying his foot to the lid. In means in accordance with the present invention, a lidding station may be provided, preferably disposed between the colourant-dispenser and the shaker, rendering it unnecessary for an operator to place the container on the floor to apply the lid. Preferably, the shelf extends past the lidding station whereby the container can be slid along the shelf from the dispenser to the shaker via the lidding station where the lid can be re-applied.

It is highly desirable that the lidding station comprises a press which is quick and easy to operate preferably by manual power deliverable by one hand whilst at the same time being also quickly and easily adjustable by the same one hand so as to accommodate containers of different heights. Such one-handed operation leaves the operator's other hand free to slide the container along the shelf so saving previous seconds.

The press may comprise a lever-operated lid-engaging member through which a pressure can be applied to the lid to press-fit it into the open mouth of the unlidded container. The operating lever may be arranged to react against one of a plurality of alternative reaction surfaces to enable the lidding device to accommodate containers of various heights. For example, three such reaction surfaces may be provided to accommodate containers of three heights of 120, 160 and 235 mm corresponding to capacities of 1, 2.5 and 5 liters.

Accordingly, this invention also provides means for providing dispersed flowable colourant in a coating composition in which there is additionally provided a lidding press for press-fitting a lid into an open mouth in an unlidded container of one of several alternative heights which press is operable manually using one hand and is therefore especially suitable for use in means for providing dispersed colourant in coating compositions contained in the contained wherein the press comprises:

1 support 2 a lid-engaging means for applying pressure to the lid to press-fit into the open mouth;

3 a main lever on which the lid-engaging means is mounted, the main lever being proximally pivotally mounted about a substantially horizontal axis on the support;

4 an upwardly extending operating lever pivotally mounted about a substantially horizontal axis on the main lever at a point between the mountings of the main lever and the lid-engaging means;

5 an extension of the operating level beyond its mounting which extension is short relative to the operating lever and 6 several alternative reaction surfaces for engagement with the short extension located one above another and all fixed relative to the mounting for the main lever and wherein rotation of the operating lever in one direction combined with rotation of the main lever can move the extension of the operating lever to and from engagement with any one of the alternative reaction surfaces and rotation of the operating lever in the opposite direction moves the extension in engagement with a reaction surface and urges the lid-engaging means downwards. The press may be fixed relative to the colorant-dispenser, shaker and shelf or it may be an independent free-standing machine. Preferably the pivotal mountings for the levers are positioned so as to provide mechanical advantage when urging the lid-engaging means downwards. The length of the extension of the operating lever is for example from 5 to 30% of the length of the remainder of the operating lever.

Extensive trials have shown that re-lidding is most efficiently done if the shelf is located at a height of from 890 to 950 mm above the floors, that is to say above the lower part of the means which is intended to stand on the floor. The container is preferably positively locatable under the press and where the lidding press is fixed in the means for providing dispersed colourant, the shelf extending between the dispenser and the shaker preferably supports the container during re-fitting of the lid to the container by the lidding press. A locating means of the type used with the dispenser is especially suitable.

In order to inhibit the likelihood of colourant drying in the outlets from the dispensing nozzles and in particular to reduce the risk of partial or total blockage of the nozzles when the dispenser is not in use, the means for providing dispersed flowable colourant in a coating composition may also be provided with a moisturising device which comprises a container of water adjacent to the nozzle outlets and from which water can evaporate to provide water vapour around the nozzle outlets. The vapour helps to prevent drying of the colourant. Conveniently, the container may be in the form of an annular trough extending below and around the nozzle outlets. A closure member may be provided which together with the water-container and nozzles helps to at least partially enclose a space around the nozzle outlets into which water can evaporate often achieving saturated vapour pressure. The moisturising member must comprise retraction and returning means for retracting the closure member from the position where it helps to enclose the nozzle to a position where it does not obstruct the passage of colourant during dispensing and then for returning the closure member when dispensing has finished. The closure member may usefully take the form of a cup which can also serve to catch any drips of colourant when it is in the enclosing position.

The moisturising device preferably further comprises a reservoir for water which reservoir is closed from the atmosphere but linked to the water-container by a tube extending from a lower region of the reservoir to the water-container whereby the water-container can be replenished with water from the reservoir in a controlled way owing to the creation of a partial vacuum in the reservoir which is occasionally relieved by the ingress of an air-bubble via the tube. It has been found that moisturising devices of this type consume very little water (for example 3 to 6 liters annually) and so a 5 liter reservoir usually only needs to be re-filled about once a year.

A labelling station may be provided at which a label is produced for application to the container. Preferably, the labelling station is positioned between the colourant-dispenser and the lidding station. The information to be carried by the label is preferably supplied by means of the computer in response to the information originally fed to it by the operator. The label may be preferably delivered through a slot in a surface adjacent the dispenser. In that way, the label can be presented to the operator at a position immediately adjacent the container at the dispenser for immediate application of the label to the container.

In order to keep an accurate check on the quantity of colourant being dispensed through the nozzles, checking means may be arranged to weigh a quantity of the colourant dispensed from each nozzle and the weight can then be compared with a known value which corresponds to the weight which would be delivered when the dispenser is operating correctly. The comparison is preferably carried out by the computer arranged to control the introduction of the colourant into the container. In the event of a discrepancy, the computer preferably signals the operator that servicing is necessary.

The shaker preferably includes (for safety reasons) an openable access door or other openable barrier which is required to be opened to enable the container to be positioned in the shaker and which is also required to be closed before the shaker will operate.

In order to aid timely servicing of the dispenser and shaker, monitoring means may be provided for monitoring various operating parameters. In that way, a signal can be provided for example via a modem to a central servicing unit, to provide an indication that servicing of one or more components is required.

The shelf extending between the dispenser and the shaker may also extend in the opposite direction away from the dispenser in order to support one or more containers awaiting the introduction of colourant.

For convenience, a number of extra shelves for carrying a stock of containers may be provided beneath the shelf which extends between the dispenser and the shaker. Preferably the extra shelves form part of a trolley which can be wheeled between the means for introducing colourant and a main storage area. The extra shelves can be used to store quantities of base paints so that they are to hand during peak trading periods. By using a trolley, operators can easily refill shelves from the main storage area during relatively slack trading periods.

Figure 2:
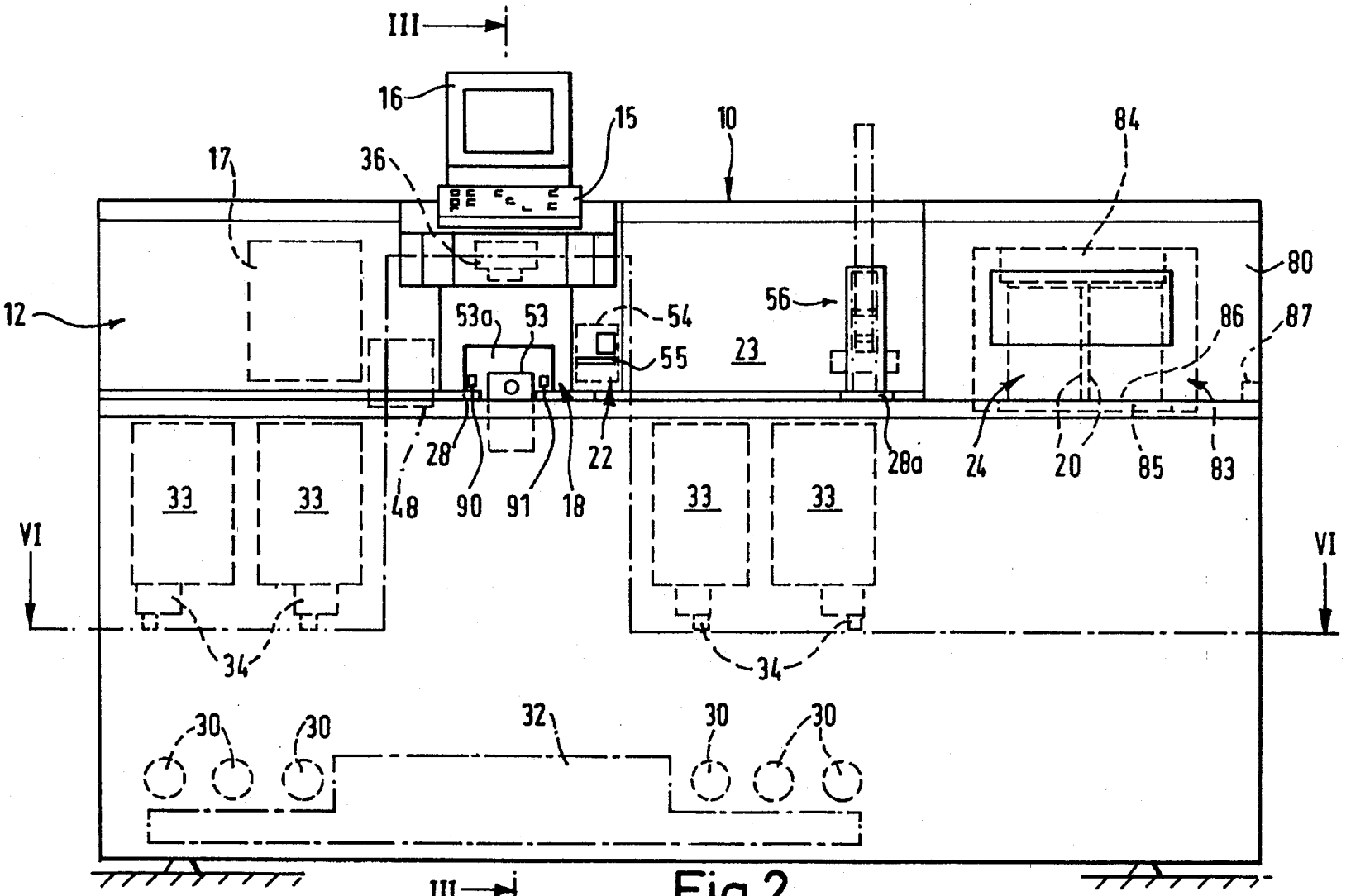
Figure 3:
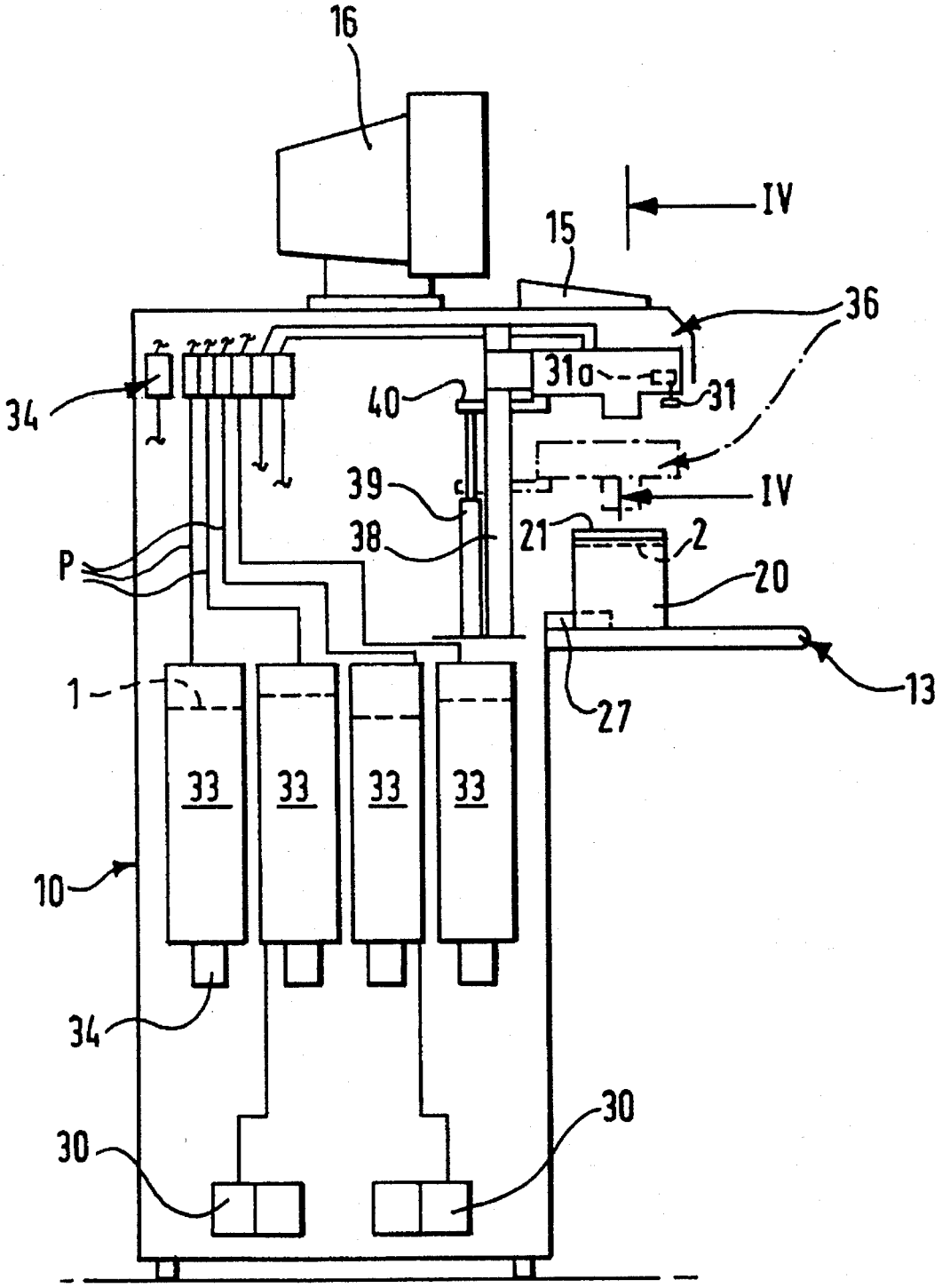
Figures 4, 5:
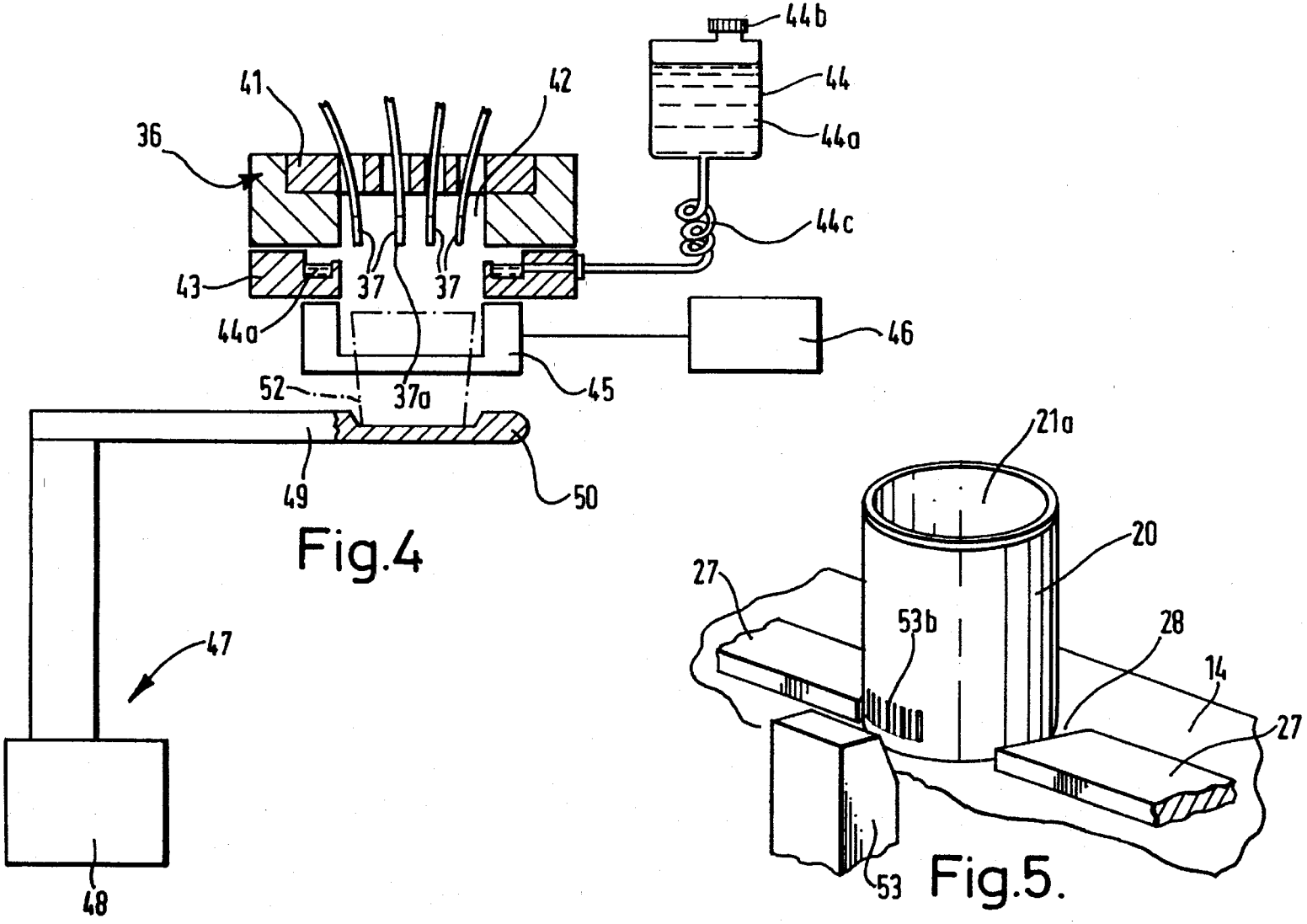

Means for introducing colourant in accordance with the invention will now be described by way of example with reference to the accompanying drawings in which:

FIG. 1 is a perspective view of a preferred form of means in accordance with the invention, FIG. 2 is a diagrammatic elevation of the means shown in FIG. 1, FIG. 3 is a diagrammatic cross-section through the means shown in FIG. 2 on line III—III in FIG. 2, FIG. 4 is a diagrammatic cross-section through part of the means shown in FIGS. 3 generally on the line IV—IV in FIG. 3 and also showing part of a checking device.

Figure 6:
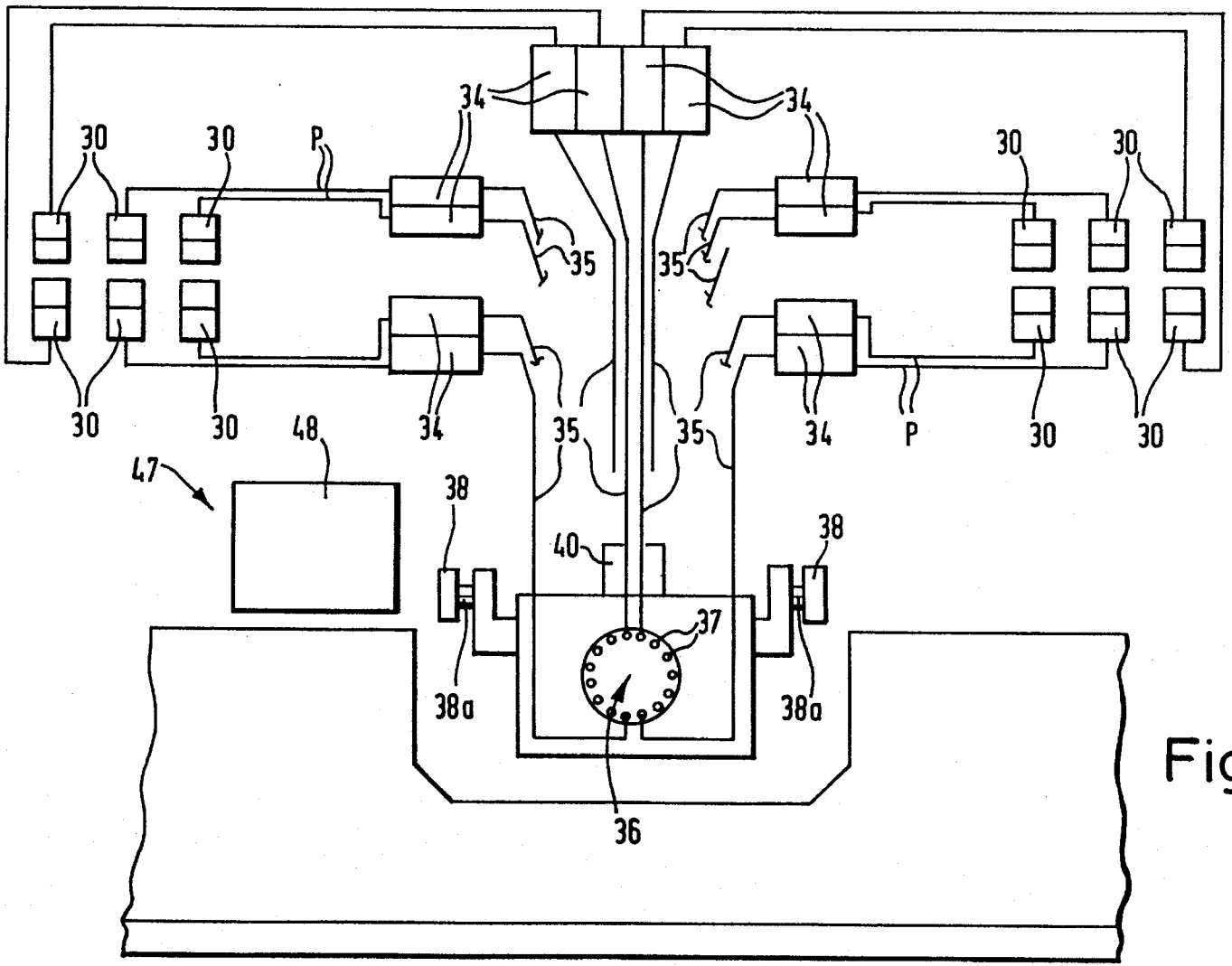
Figure 8:
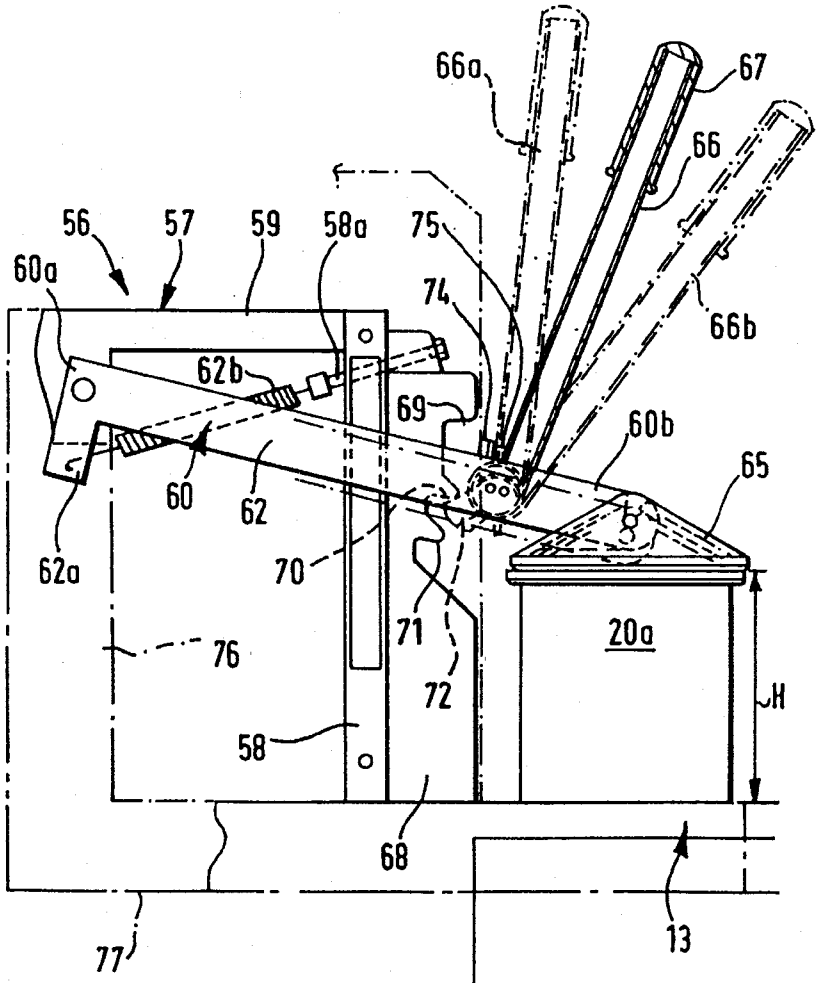
Figure 7:
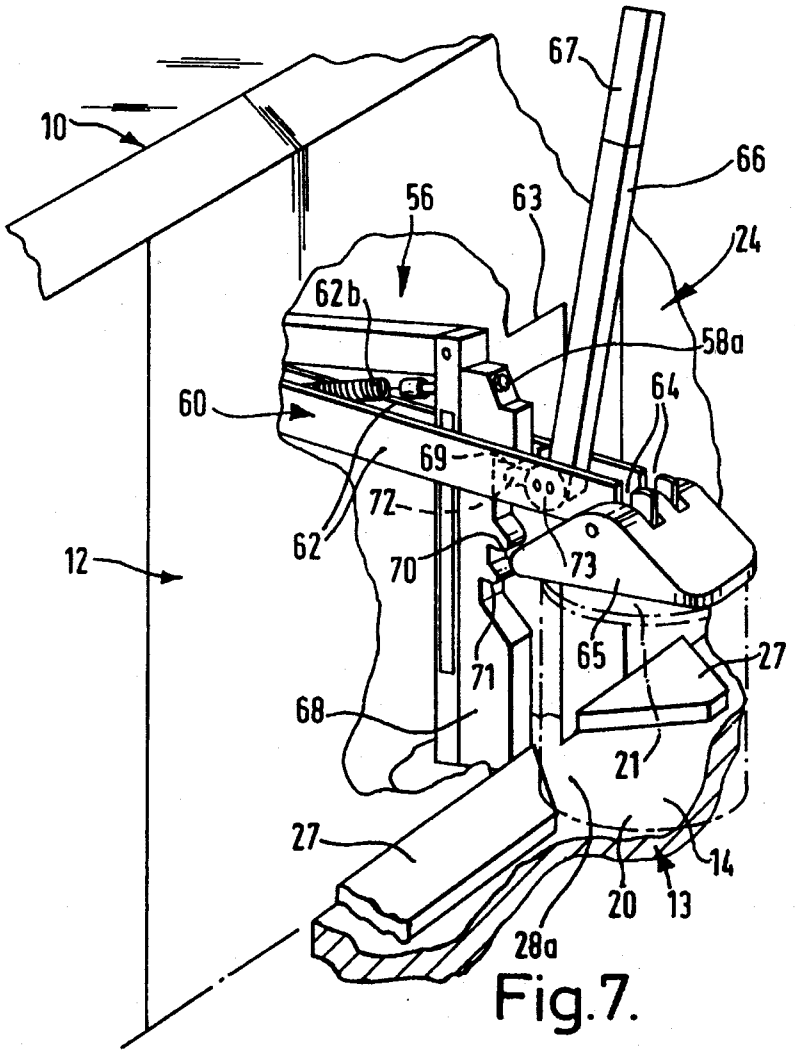
Figure 9:
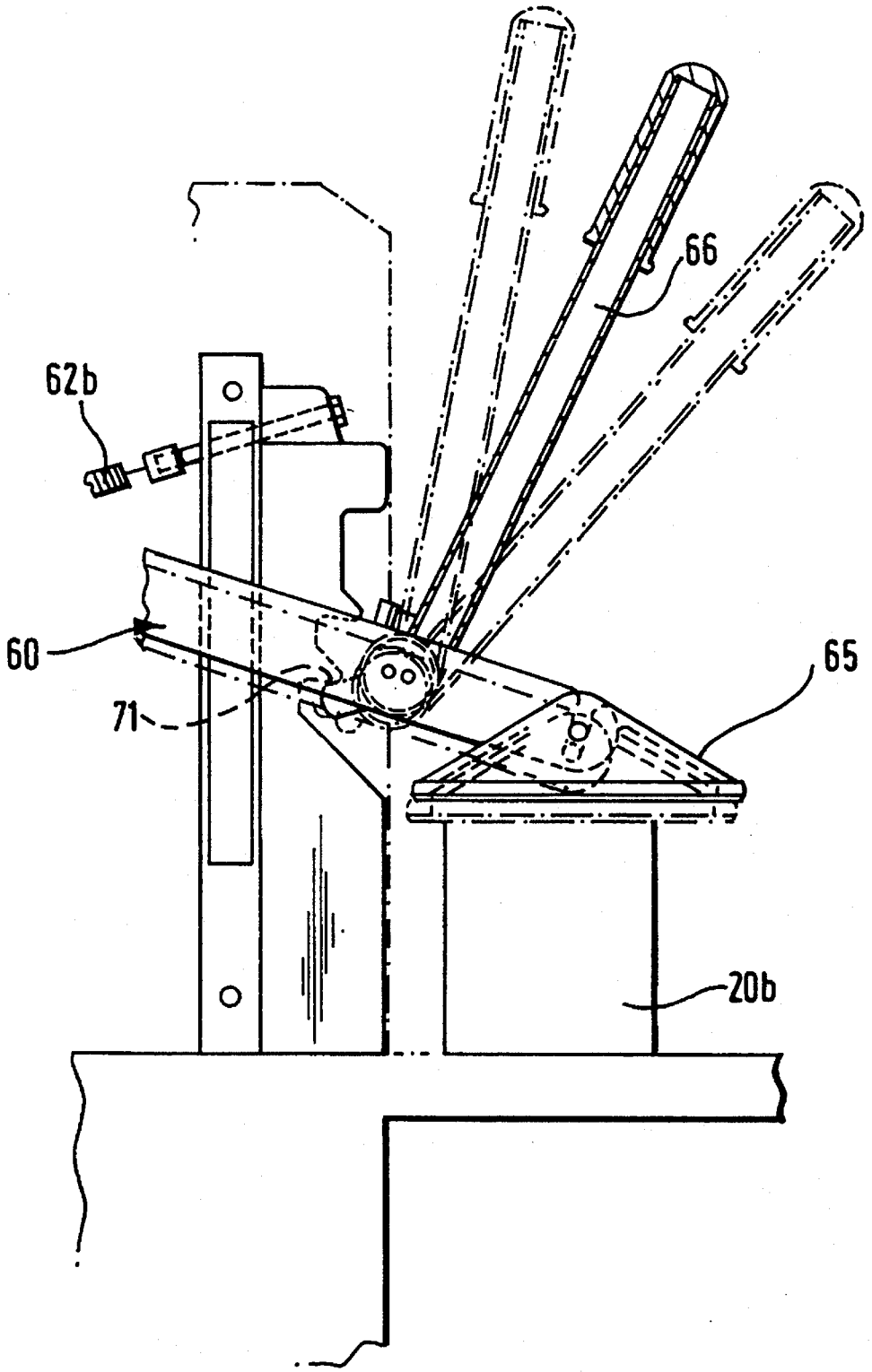

FIG. 5 is a diagrammatic rear view of an unlidded container in position on the shelf of the means and illustrating the way in which a bar code on the container is positioned adjacent a sensor, FIG. 6 is a diagrammatic cross-sectional view of part of the means shown in FIG. 2 on the line VI—VI in FIG. 2, FIG. 7 is a perspective view of part of a lidding press at a lidding station of the means, FIG. 8 is a side view of the lidding device shown in FIG. 7 with a container shown in position of lidding and FIG. 9 is a side view of part of the lidding press shown in FIG. 8 with a container of different size in position.

Referring to FIG. 1, the means comprises a housing 10 which incorporates supporting structure (not shown) for various components of the machine to be described below.

The housing 10 has a front vertical surface 12 from which extends a horizontal shelf 13 having an upper surface 14. A keyboard 15 and screen 16 are arranged on the top of the housing 10 and are associated with a computer 17 (see FIG. 2) the function of which is described below.

The means include a colourant-dispenser 18 at which a colourant 1 (FIG. 3) can be provided into an unlidded container 20 (FIG. 3) via its open mouth 21*a* (FIG. 5). The container 20 stands on surface 14 of shelf 13 and contains a base paint 2. Immediately to the right of the colourant-dispenser 18 is the labelling station 22. Immediately to the right of the labelling station 22 is a lidding station and immediately to the right of that is a shaker 24 for dispersing colourant 1 into base paint 2. The various other components are described in more detail below.

The shelf 13 is set at a height of 920 mm above the floor leaving sufficient clearance beneath shelf 13 to accommodate at least one, but preferably two multi-shelved trolleys 25. In FIG. 1 the trolley is shown with three shelves 26 for lidded containers 20, 20*a* and 20*b* of alternative standard capacities and therefore alternative heights H (FIG. 8).

The upper surface 14 of the shelf 13 carries spaced apart plates 27 which together define a V-shaped recess 28 for positively locating an unlidded container 20 in position in V-block manner. The way in which the plates 27 locate the container can be seen clearly from FIG. 5. The angle between the arms of "V" is 30° .

As shown in FIGS. 2 and 3, the housing 10 houses a series of pumps 30 (for example twelve in number) suitably driven by a drive arrangement 32.

A series of colourant-reservoirs 33 is provided for alternative colourants additive 1 and each reservoir has a motor driven stirring arrangement 34 thereon. Such stirring helps to keep the colourant flowable and it inhibits settlement of certain dense pigments. Each of the pumps 30 is arranged to pump colourant 1 from one of the reservoirs 33 into a circulatory path P provided in known manner for each pump and reservoir so that operation of the pump will cause circulation of the colourant along the associated path. The paths P include respective valves indicated generally at 34 (see FIGS. 3 and 6). Operation of any one of the valves will allow colourant in its path P to be diverted through the valve and into an associated feed conduit 35 (four only of which are completely shown in FIG 6). The conduits 35 pass through an apertured locating plate 41 (see FIG. 4) in a dispensing head 36 and each conduit 35 then defines a nozzle 37 which terminates in a nozzle outlet 37*a*.

The dispensing head 36 is in the form of a carriage which is mounted for raising and lowering movement on rails 38 in the housing 10. The dispensing head 36 may frictionally engage the rails 38 or be provided with rollers 38*a* which run against the rails 38. The raising and lowering movement of the dispensing head 36 is effected by means of an electric motor 39 which moves a rearward extension 40 on the dispensing head 36. In FIG. 3, the upper travel limit of the dispensing head 36 is shown in full lines and the lower travel limit in broken lines. A cut-out device (31 plus 31*a*) is provided to prevent a finger or hand of the operator becoming trapped between the dispensing head 36 and the top of the container 20. The cut-out device includes a floating plate or bar 31 which operates a switch 31*a* if the plate moves towards the switch through hand or finger contact. Operation of the switch 31*a* will cut off the operation of the motor 39 to prevent further downward movement of the dispensing head 36.

The dispensing head 36 defines a circular space 42 in which the dispensing nozzles 37 are positioned. Below and adjacent the dispensing head 36 is an annular water trough 43 which is raisable and lowerable with the dispensing head 36 so that trough 43 is always adjacent nozzle outlet 37*a*. Trough 43 receives water 44*a* from a reservoir 44 suitably arranged within or to the rear of the housing 10 and closed from the atmosphere by cap 44*b*. A bleed of water from the reservoir 44 via coiled tube 44*c* replenishes trough 43 replacing water slowly lost by evaporation into space 42 and so maintains water in the trough 43 at a pre-determined level. Because the bleed creates a slight partial vacuum in reservoir 44, the replenishment of trough 43 occurs in a controlled way with the vacuum being occasionally relieved by the ingress of an air-bubble via tube 44*c*. A cup-shaped closure 45 can be positioned immediately beneath the water trough 43 as shown in FIG. 4 so that the closure together with the water trough and nozzles helps to at least partially enclose a space around the nozzle outlets into which water from trough 43 can evaporate often saturating the air. In this way, colourant is inhibited from drying in the nozzles 37. The closure 45 can be retracted from the position shown in FIG. 4 by means of a suitable actuator 46 in order to clear the nozzles so as not to obstruct the passage of colourant during dispensing.

As shown in FIG. 4, a monitoring means 47 is provided adjacent the colourant dispenser 18. The monitoring means 47 includes a load sensor 48 which supports a recessed plate 50. The plate can be moved into a position shown in FIG. 4 immediately beneath the nozzles 37 and a cup 52 (shown in broken lines in FIG. 4) can be positioned on the recessed plate 50 for receiving samples of colourant from the nozzles 37 as described below.

The dispenser includes a sensor 53 immediately adjacent an opening 53*a* in the front surface 12 of the housing 10. The sensor 53 is positioned so as to be capable of sensing a bar code 53*b* on each container 20 (see FIG. 5) when the container is located in the recess 28.

The labelling station 22 incorporates a labelling device 54 which delivers an adhesive label 54*a* (FIG. 1) through a slot 55 in the front panel 12 of the housing.

The lidding station 23 includes a lidding press 56 shown in detail in FIGS. 7 to 9. The lidding press comprises a frame 57 within the housing 10 comprising a vertical pillar 58 and a rearwardly extending member 59 built in to the supporting structure within the housing 10. Proximal end 60*a* of a main lever 60 is pivotally mounted on member 59 about a substantially horizontal axis. Main lever 60 comprises two spaced apart sections 62 which extend one each side of the pillar 58. The main lever 60 projects through an opening 63 in the front panel 12 of the housing 10 and extends over the shelf 13. The distal ends 60*b* of the lever sections 62 are provided with U-shaped recesses 64 in which a lid engaging member 65 is pivotally mounted about a substantially horizontal axis. The sections 62 of the main lever 60 carry a substantially horizontal pivotal mounting 73 for an upwardly extending operating lever 66 having a handle 67 at its upper end. Mounting 73 is located closer to the distal end 60*b* of main lever 60 than to its proximal end 60*a*. Preferably the distance from mounting 73 to the proximal end 60*a* is at least twice that from mounting 73 to distal end 60*b* thereby gaining a substantial mechanical advantage when urging down lid-engaging member 65. The pillar 58 supports an upwardly extending reaction member 68 formed with three substantially horizontal alternative reaction surfaces 69, 70 and 71 positioned one above another and fixed relative to mounting 73 for the operating lever 66 so as to allow the press to be used in re-lidding containers of different heights. The reaction surfaces are positioned so as to be engageable by a short angled extension of operating lever 66 in the form of lug 72. Lug 72 is fixed relative to the remainder of operating lever 66 and extends beyond its pivotal mounting 73 in a direction inclined to the remainder of lever 66. Lug 72 is much shorter than the remainder of lever 66 being only 10 to 15% of its length thereby allowing a substantial mechanical advantage to be gained when operating lever 66 is used to urge down lid-engaging member 65. The spaced sections 62 of the main lever 60 support between them a mounting 74 for a compression spring 75 which biases the lever 66 into the full line position shown in FIG. 7, FIG. 8 or FIG. 9 where lug 72 is in engagement with one or other of the reaction surfaces 69, 70 or 71. The proximal ends of lever sections 62 have downwardly projecting arms 62*a* between which is fastened one end of a tension spring 62*b*. The other end of the spring 63 is suitably secured to a bolt 58*a* which can be rotated to adjust the spring tension.

In order to press-fit a lid 21 into the tallest of the alternative containers 20 (shown in broken lines in FIG. 7) after the press has been in use with a shorter container, operating lever 66 is initially pivoted forwardly against the bias of spring 75 to the position 66*a* shown in broken lines in FIG. 8. Such action moves the lug 72 clear of the reaction surfaces 69 and 70. With the lever 66 in the 66*a* position, the main lever 60 is pivoted upwardly by the tension in spring 62*b* to bring the lug 22 immediately beneath the uppermost reaction surface 69. The operating lever 66 under the bias of spring 75 is then allowed to return so as to resume its full line position where lug 72 engages reaction surface 69. This whole operation can be accomplished using only one hand. Unlidded container 20 is slid along surface 14 of shelf 13 and is located in a V-shaped recess 28*a* similar to recess 28 in V-block manner. The recess 28*a* is defined by plates 27 on the shelf 13 as before. The left-hand plate 27 as viewed in FIG. 7 is a continuation of the plate defining one arm of the recess 28. The operating lever 66 is then rotated downwardly towards the position 66*b* again needing the use of only one of the operator's hands whereupon the lug 72 reacts against the surface 69 causing the pivot of lever 66 to press down on main lever 60 so gaining a substantial mechanical advantage. The main lever 60 applies a substantial downward pressure on the lid engaging member 65 sufficient to press-fit lid 21 into the open mouth 20*a* of container 20.

FIGS. 8 and 9 illustrate the two further sized containers 20*a*, 20*b* which can be accommodated by the lidding press 56. In order to press-fit lids 21 into smaller containers 20*a*, 20*b*, lug 72 is moved into engagement with the appropriate lower reaction surfaces 70 or 71. The lidding press 56 is then operated as explained above.

It is envisaged that the lidding press 56 may be useful as a free standing hand operated machine. In such a case, the frame 67 may include a rear vertical pillar 76, the pillar 76 and the pillar 58 extending upwardly from a base 77 which projects forwardly of the pillar 58 to support a container 20.

The shaker 24 includes a vertical sliding door 80 having a winder 82. Lifting of the door 80 into the broken line position shown in FIG. 1, provides access to a mixing chamber. The shaker may be of a kind similar to that shown in GB-A-1,310,655 the contents of which are herein incorporated by reference. The shaker 83 is capable of receiving two of the largest anticipated containers 20 which are held between upper and lower plates 84, 85. The lower plate has an upper surface 86 which is substantially co-planar with the surface 14 of the shelf 13 when the shaker is in its rest condition. In the interest of safety, lifting of the door 80 operates a switch 87 to disable a drive motor for the shaker The operation of the machine will now be described.

On receiving an order for paint to be produced by mixing a colourant with a base paint, an operator types information corresponding to the required final paint colour into the keyboard 15 and the computer 17 on receiving the information causes the screen 16 to display the required base paint. The operator then takes the appropriate sized lidded container 20, 20*a* or 20*b* from the trolley 25, removes its lid 21 and locates the container in the "V"-shaped recess 28 with the base of the container in engagement with the edges of the plates 27 as shown in FIG 5 and with the bar code 53*b* facing the sensor 53. The sensor 53 has a wide field of view so that accurate alignment of the bar code 53*b* with the sensor 53 is not absolutely essential. The bar code 53*b* corresponds to a particular formulation of base paint and if the bar code is not present or if a bar code is present which does not correspond to a code recognised by the computer 17, the machine will not operate. In addition to the bar code sensor 53, a further sensor 90 and 91 may also be provided which senses the presence of the container when positioned within the recess. The further sensor could comprise a light transmitter 90 and a receiver 91 (FIG. 2), the light beam of which is interrupted by the presence of the container 20. The further sensor would be used to prevent the machine from operating in the absence of the container.

Once the unlidded container 20 is in position, the operator presses a start button on the keyboard 15 to provide a start signal for the machine. Having processed the information from the keyboard 15, the computer takes a reading from the bar code sensor 53 immediately before additive is introduced to ensure that a correct container 20 has been chosen. The pumps 30 are then operated and the actuator 46 retracts the closure 45. Next, actuator 39 is operated to raise or lower the tinting head 36 into the appropriate vertical position depending upon the size of the container and one or more of the valves 35 is/are opened to allow an appropriate amount of one or more colourants to be pumped each from its own circulating path P through one or more of the nozzles 37 and into the unlidded container 20. On completion of the colour-dispensing stage, the computer provides an appropriate signal to the screen 16 for the operator. The labelling device 55 delivers a label 55*a* through the slot 55*b*. The label bears printed information corresponding e.g. to the colour of the paint and the operator applies the label 55*a* to the container. The information is supplied to the labelling device 55 by the computer 17.

The operator then slides the unlidded container 20 along the surface 14 of the shelf 13 to the lidding station 23 and lays lid 21 over the open mouth of container 20. If the previous container to pass through lidding station 23 was of a height different from that of container 20, then the operator must adjust lidding press 56 to lug 72 with the appropriate alternative reaction surface. When lug 72 is correctly engaged, container 20 carrying lid 31 is slid under lid-engaging member 65 and operating lever 66 is pulled down to press-fit the lid into the open mouth. The re-lidded container is then slid further along the surface 14 to the shaker 24. The door 80 of shaker 24 is raised and the re-lidded container is slid into the mixing chamber on to the lower plate 85. The door 80 is then lowered and a start button (not shown) is pressed to cause the container to be clamped between the plates 84, 85 and to start the shaker 24. The mixing time is selected by the operator in accordance with the nature of the paint, for example gloss paints need shorter mixing times than silk paints which in turn need less than matts. Mixing time is controlled by a timer and at the end of the mixing cycle the door 80 is opened and the container removed.

The entire process has been found to take a little over seventy seconds which is a significant improvement over the typical time of around two minutes for comparable tinting using existing machinery.

It will be noted that the shelf 13 extends to the left of the dispenser 18 as shown in FIGS. 1 and 2. This is advantageous in that an operator can place at least two large containers 20 on the surface 14 to the left of the dispenser 18 while colourant is being dispensed into another container by the dispenser. It is then a simple task to slide the first container away from the dispenser after completion of the dispensing step and then to slide another container into place in the recess 28.

Alternatively, a second operator can type in information relating to a second order which will be held in the memory of the computer 17. The second operator can then place the appropriate containers of base paint on the surface 14 to the left of the dispenser 18 so that they form a queue while a first order is being executed. In that way, an improved throughput of orders is achieved which cannot be obtained with existing machinery.

After a final order has been executed, the computer causes the actuator 46 to return the closure 45 into the FIG. 4 position to inhibit drying of colourant in the nozzle 37*a*.

From time to time, it is necessary to check the accuracy of quantities of colourant dispensed through the nozzles 37. To do that, the recessed plate 50 is positioned as shown in FIG. 4 and the cup 52 is placed on the plate 50 beneath the nozzles 37. Each valve 34 is then opened in turn. The first valve permits a quantity of colourant to be dispensed into the cup 52 by a predetermined number of revolutions of the pump. The weight of colourant dispensed is sensed by the load sensor 48 which sends a signal to the computer 17. A comparison is then made within the computer between the weight of colourant actually dispensed and the weight of colourant which should be delivered for the same number of pump revolutions when the machine is operating correctly. Provided that the measured weight falls within a given tolerance, no adjustment to the operation of that valve is required. Howevers ifs for example, the nozzle 37 has developed a small blockage which is effectively reducing flow, the computer will signal to the operator that servicing is required. Each valve is opened in turn to dispense colourant into the cup and the load sensor 48 is zeroed each time. The various signals from the load sensor 48 are compared within the computer 17 for the range of values checked and the checking operation can be performed quite quickly. After the checking operation has finished, the recessed plate 50 is moved clear of the tinting head 36.

The means may incorporate diagnostic facilities which will highlight any false occurrence, for example, in major components such as pumps and actuators. For that purpose, the means can be connected to a modem which, for example, will be monitored at the end of each week from a central servicing base and any problem which is highlighted can be recorded and servicing crews can be advised of the correct part for replacement prior to their visit.

Also, it is envisaged that the software will have within it a maintenance program which will record various operations. For example, it may indicate when a particular pump 30 needs changing because the particular pigment being pumped is especially abrasive and will create wear over a given number of revolutions of the pump which will warrant early replacement of the pump. Such a maintenance program helps to provide a servicing crew with an indication that within a certain period a particular pump or other component will need to be changed. By predicting servicing in that way, it is possible to move the time of replacement closer to the time of anticipated breakdown rather than merely changing over the component during a routine service visit.

The housing 10 includes several removable panels (not shown) to give access to the various components of the machine.

Instead of the feed conduits 35 extending through a locating plate 41, the nozzles may be made in one piece with or mounted on a plate which takes the place of a locating plate 41 and the various lengths of conduit 35 are connected thereto. In that ways conduit between the valves 34 and the dispensing head 36 can easily be replaced without affecting the nozzles.

It is envisaged that the shaker 24 will be in the form of a unit separate from the remainder of the means and which will be placed immediately adjacent thereto in the position shown in FIG. 1. In that way any vibration from the shaker will not be transmitted to the remainder of the means from introducing colourant.

What I claim is:

1. Means for providing dispersed flowable colourant (1) in a coating composition (2) contained in a liddable container (20) which container may have one of several alternative heights, the means comprising a colourant-dispenser (18) comprising a plurality of nozzles (37) through which flowable colourant can be pumped into the container when unlidded and a shaker (24) laterally spaced from the dispenser wherein a fixed shelf (13) extends between the dispenser and the shaker along which shelf the container can be moved from the dispenser to the shaker and wherein the nozzles of the dispenser can be raised and lowered relative to the fixed shelf.

2. Means according to claim 1 in which the dispenser comprises a sensor (53) positioned so as to be able to sense a code means (54) bearing information relevant to the container and/or the coating composition therein which code means is provided on the container.

3. Means according to claim 2 in which the information provided by the sensor is compared by a computer to the information supplied via an input means to provide a check that the container placed in position to receive the colourant is of the correct capacity and contains the correct base coating composition.

4. Means according to claim 1 in which the dispenser includes "V"-shaped positive location means (28) for locating the container (2) in a position to receive the colourant.

5. Means according to claim 4 in which the angle between the arms of the "V" of the "V"-shaped recess is from 27° to 33°.

6. Means according to claim 1 in which the shelf extending between the dispenser and the shaker is located at a height of from 890 to 950 mm above the lowest part of the means intended to stand on a floor.

7. Means according to claim 1 in which the shelf also extends past the dispenser in a direction away from the shaker.

8. Means according to claim 1 in which a lidding station (23) is provided between the dispenser and the shaker at which lidding station an unlidded container supported on the shelf and having an open mouth across which a lid (21) is laid can have the lid press-fitted into the open mouth.

9. Means according to claim 8 in which a "V"-shaped location means is provided at the lidding station.

10. Means for providing dispersed flowable colorant in a coating composition contained in a liddable container which container may have one of several alternative heights, the means comprising a colorant-dispenser comprising a plurality of nozzles through which flowable colorant can be pumped into the container when unlidded and a shaker laterally spaced from the dispenser wherein a fixed shelf extends between the dispenser and the shaker along which shelf the container can be moved from the dispenser to the shaker and wherein the nozzles of the dispenser can be raised and lowered relative to the fixed shelf, the colourant-dispenser including a moisturising device for inhibiting drying of colourant in outlets (37*a*) from the nozzles whilst the dispenser is not in use and the moisturising device comprises a container (43) for water (44*a*) adjacent the nozzle outlets which container is raisable and lowerable with the nozzles.

11. Means according to claim 10 in which the water-container comprises an annular trough extending below and around the nozzle outlets.

12. Means according to claim 10 in which the moisturising device also comprises a closure member (45) which together with the water-container and nozzles helps to at least partially enclose a space around the nozzle outlets into which water-vapour can evaporate from the water-container and wherein the moisturising device further comprises retraction and returning means for moving the closure member (45) to and from a position in which it is clear of the nozzles so as to permit free passage for the colourant from the nozzles to the container.

13. Means according to claim 12 wherein the moisturising device further comprises a reservoir (44) for water which reservoir is closed from the atmosphere but linked to the water-container by a tube (44*c*) extending from a lower region of the reservoir to the water-container whereby the water-container can be replenished with water from the reservoir in a controlled way owing to the creation of a partial vacuum in the reservoir which is occasionally relieved by the ingress of an air-bubble via the tube.

14. Means according to claim 10 in which there is also provided a lidding press (56) for press-fitting a lid (21) into an open mouth (21*a*) in an unlidded container (20) of one of several alternative heights which press is operable manually using one hand and is therefore especially suitable for use in means for providing dispersed colourant (1) in coating compositions (2) contained in the container wherein the press comprises:

(1) a support (57, 58 and 59);

(2) a lid-engaging means (65) for applying pressure to the lid to press-fit it into the open mouth;

(3) a main lever (60) on which the lid engaging means (65) is mounted, the main lever being proximally pivotally mounted about a substantially horizontal axis on the support;

(4) an upwardly extending operating lever (66) pivotally mounted about a substantially horizontal axis on the main lever at a point between the mountings of the main lever and the lid-engaging means;

(5) an extension of the operating lever (72) beyond its mounting which extension is short relative to the operating lever and (6) several alternative reaction surfaces (69, 70, 71) for engagement with the short extension located one above another and all fixed relative to the mounting for the main lever and wherein rotation of the operating lever in one direction combined with rotation of the main lever can move the extension of the operating lever to and from engagement with any one of the alternative reaction surfaces and rotation of the operating lever in the opposite direction moves the extension into engagement with a reaction surface and urges the lid-engaging means downwards.

15. A means according to claim 14 wherein in the press the length of the extension to the operating lever is from 5 to 30% of the length of the remainder of the operating lever.

16. A means according to claim 14 wherein in the press, the extension to the operating lever extends in a direction inclined to the remainder of the operating lever.

17. A means according to claim 14 wherein in the press, the distance from the mounting (73) for the operating lever to the proximal end (60*a*) of the main lever is at least twice the distance from the mounting (73) to the distal end (60*b*).

18. A means according to claim 14 wherein the extension to the operating lever is biassed into engagement with one or other of the reaction surfaces.

* * * * *